US007828910B2

(12) United States Patent
Benn et al.

(10) Patent No.: US 7,828,910 B2
(45) Date of Patent: Nov. 9, 2010

(54) METHOD AND PROCESS FOR THERMOCHEMICAL TREATMENT OF HIGH-STRENGTH, HIGH-TOUGHNESS ALLOYS

(75) Inventors: Raymond C. Benn, Hartford, CT (US); Clark V. Cooper, Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 741 days.

(21) Appl. No.: 11/792,787

(22) PCT Filed: Dec. 9, 2005

(86) PCT No.: PCT/US2005/044798

§ 371 (c)(1), (2), (4) Date: Jun. 11, 2007

(87) PCT Pub. No.: WO2006/063315

PCT Pub. Date: Jun. 15, 2006

(65) Prior Publication Data

US 2008/0128052 A1 Jun. 5, 2008

Related U.S. Application Data

(60) Provisional application No. 60/635,404, filed on Dec. 9, 2004.

(51) Int. Cl.
*C23C 8/34* (2006.01)

(52) U.S. Cl. ..... 148/219; 148/232; 148/233

(58) Field of Classification Search ..... 148/232, 148/219, 233

See application file for complete search history.

(56) References Cited

U.S. PATENT DOCUMENTS

| | | | |
|---|---|---|---|
| 2,496,246 | A | 1/1950 | Jennings |
| 3,053,704 | A | 9/1962 | Munday |
| 5,503,797 | A | 4/1996 | Zoch et al. |
| 6,702,981 | B2 | 3/2004 | Hetzner |

FOREIGN PATENT DOCUMENTS

| | | | |
|---|---|---|---|
| JP | 041848 | A | 10/1995 |

*Primary Examiner*—Roy King
*Assistant Examiner*—Jessee R. Roe
(74) *Attorney, Agent, or Firm*—Kinney & Lange, P.A.

(57) ABSTRACT

High toughness, high strength alloys are thermochemically processed by performing concurrent bulk alloy heat treatment and surface engineering processing. The concurrent steps can include high temperature solutionizing together with carburizing and tempering together with nitriding.

10 Claims, 2 Drawing Sheets

METHOD AND PROCESS FOR THERMOCHEMICAL TREATMENT OF HIGH-STRENGTH, HIGH-TOUGHNESS ALLOYS

BACKGROUND OF THE INVENTION

The present invention relates generally to surface processing including combination with bulk heat treatment, of alloys, and more particularly, to methods and processes for thermochemical treatment to reduce production time and cost, that minimize dimensional alteration, and the identification of alloys that possess properties and microstructures conducive to surface processing in such a way that the processed alloy possesses desirable surface and core properties that render it particularly effective in applications that demand superior properties such as power transmission components.

For iron-based metal alloy components, such as power transmission components, it is often desirable to form a hardened surface case around the core of the component to enhance component performance. The hardened surface case provides wear and corrosion resistance while the core provides toughness and impact resistance. In particular, a class of high-strength, high-toughness alloys is suitable for application of the thermochemical treatments.

There are various conventional methods for forming a hardened surface case on a power transmission component fabricated from a steel alloy, while retaining the original hardness, strength and toughness characteristics of the alloy. Conventional methods include carburizing via atmosphere (gas), liquid, pack, plasma or vacuum methods. Similarly, nitriding via gas, salt bath or plasma conventional methods may also be used to harden the surface. Alternatively, high current density ion implantation may be used to essentially eliminate subsequent dimensionalizing processes.

Different surface processing and bulk alloy heat treatment steps are often performed independently and in sequence which leads to extended processing times, costs and delivery.

Disadvantages with conventional surface processing and conventional bulk alloy heat treatments and properties include concerns with structure control, e.g. grain growth at high temperatures, quench cracking and softening in service because conventional alloy tempering temperatures are relatively low.

Thus, there remains a need for both reducing processing times, costs and delivery and also increasing the performance of surface hardened alloy products.

Accordingly, it is desirable to identify concurrent thermochemical process steps that, when applied to a class of high strength, high toughness alloys and products thereof, minimize the manufacturing cycle times, costs and delivery; while retaining the desired increase in performance capability. Products of the alloy class may be in multiple forms.

BRIEF SUMMARY OF THE INVENTION

With this invention, products manufactured from high toughness, high strength alloys may be thermochemically processed such as to synergistically combine selected surface engineering and bulk alloy heat treatment steps, thereby effecting significant savings in processing times, costs and delivery, while retaining the desired increase in performance capability.

An embodiment of the thermomechanical process may be comprised of a combined step of high temperature solution heat treatment and a surface engineering process (e.g. carburizing), a quenching step, a refrigeration step and a reheating step to temper the alloy.

Another embodiment of the thermomechanical process may be comprised of the above followed by an independent surface engineering process (e.g. nitriding) at a temperature less than the tempering temperature.

Another embodiment of the thermomechanical process may be comprised of a combined step of high temperature solution heat treatment and a surface engineering process (e.g. carburizing), a quenching step, a refrigeration step and a combined step of reheating to temper and a surface engineering process (e.g. nitriding).

Embodiments of the invention may make use of a class of high toughness, high strength alloy steels containing iron, nickel, cobalt, and a metallic carbide-forming element.

The class of alloys may be manufactured in various product forms while retaining their high performance capability, which include: (a) ribbon, flakes, particulates or similar form produced by rapid solidification from the liquid or missed liquid-solid phase; (b) those formed through consolidation or densification from powders or particles, including but not limited to sintered and hot-isostatically-pressed (HIP'ed) forms; (c) those produced by or in all types of castings; (d) those produced by forging or other wrought methods, irrespective of process temperature (cold, warm, or hot); (e) those produced by stamping or coining; (f) those produced by the consolidation of or including nanometer, or substantially similar, sized particles.

DETAILED DESCRIPTION

Typical operating conditions for alloy bulk heat treatment steps and thermo-chemical processes may fall, or may possibly be adjusted to fall, within the same range of temperatures. For example, High Strength, High-Toughness (HSHT) ferrous alloys may have typical solutionizing (austenitizing) temperatures of e.g. 1500-2100° F., that are in the same approximate range of typical temperatures used in carburizing e.g. ~1600-1950° F., or carbonitriding e.g. ~1500-1700° F., or boronizing e.g. ~1400-2000° F. Combining these high temperature solutionizing and surface hardening processes appropriately, leads to reduced manufacturing cost and process time.

Similarly, tempering, or tempering plus age, treatments for typical HSHT alloys in this class, fall in the range of ~800-950° F. Nitriding processes for surface hardening can be performed in the range of ~600-1000° F., so there is potential for combining the two steps into one; thereby also saving process costs and time.

Figure 1:
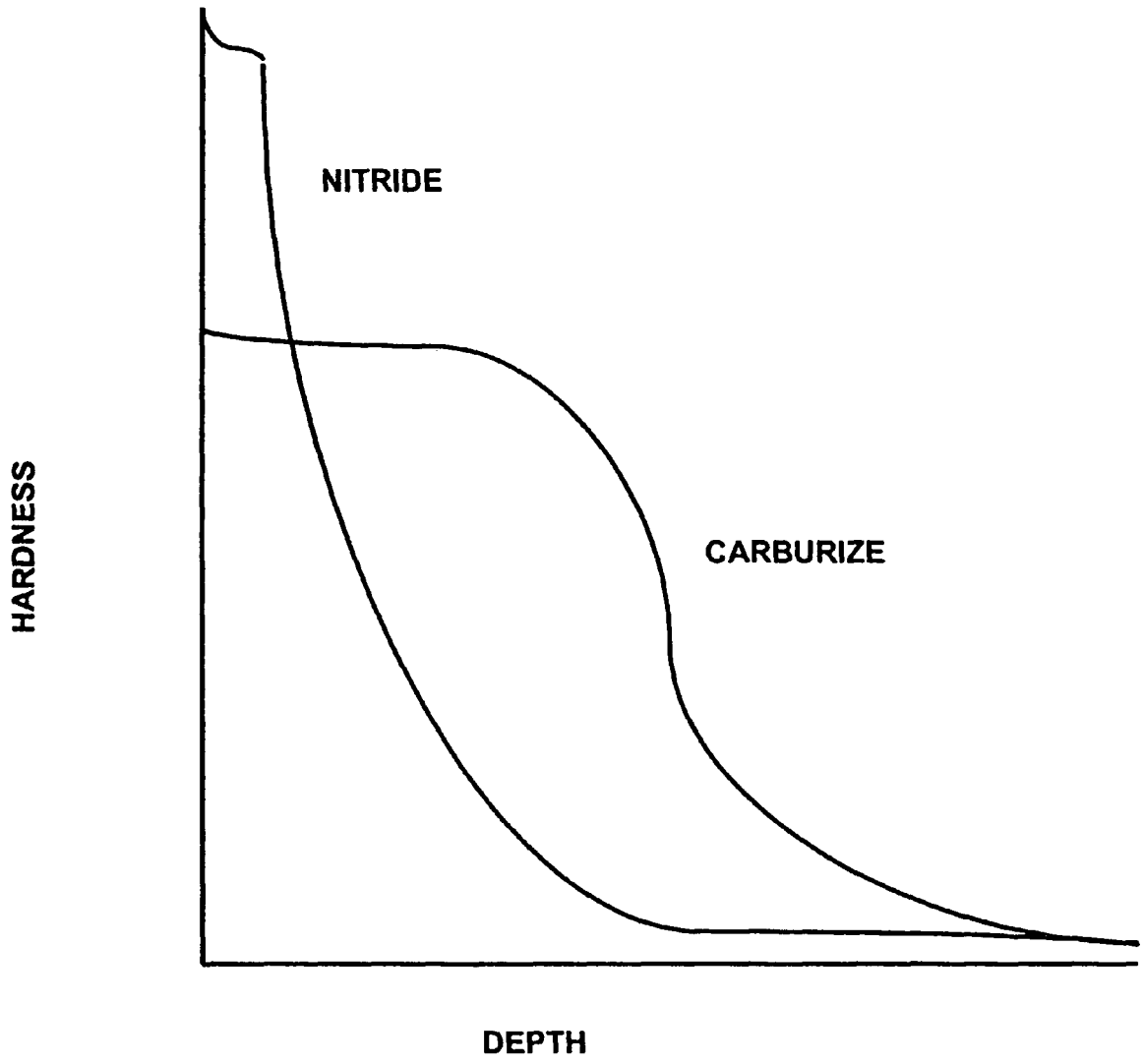
FIG. 1 is a schematic plot of surface engineered, (e.g. carburize, nitride), hardness profiles.

FIG. 1 shows a schematic of typical surface engineered hardness profiles that may result from carburizing or nitriding processes.

Figure 2:
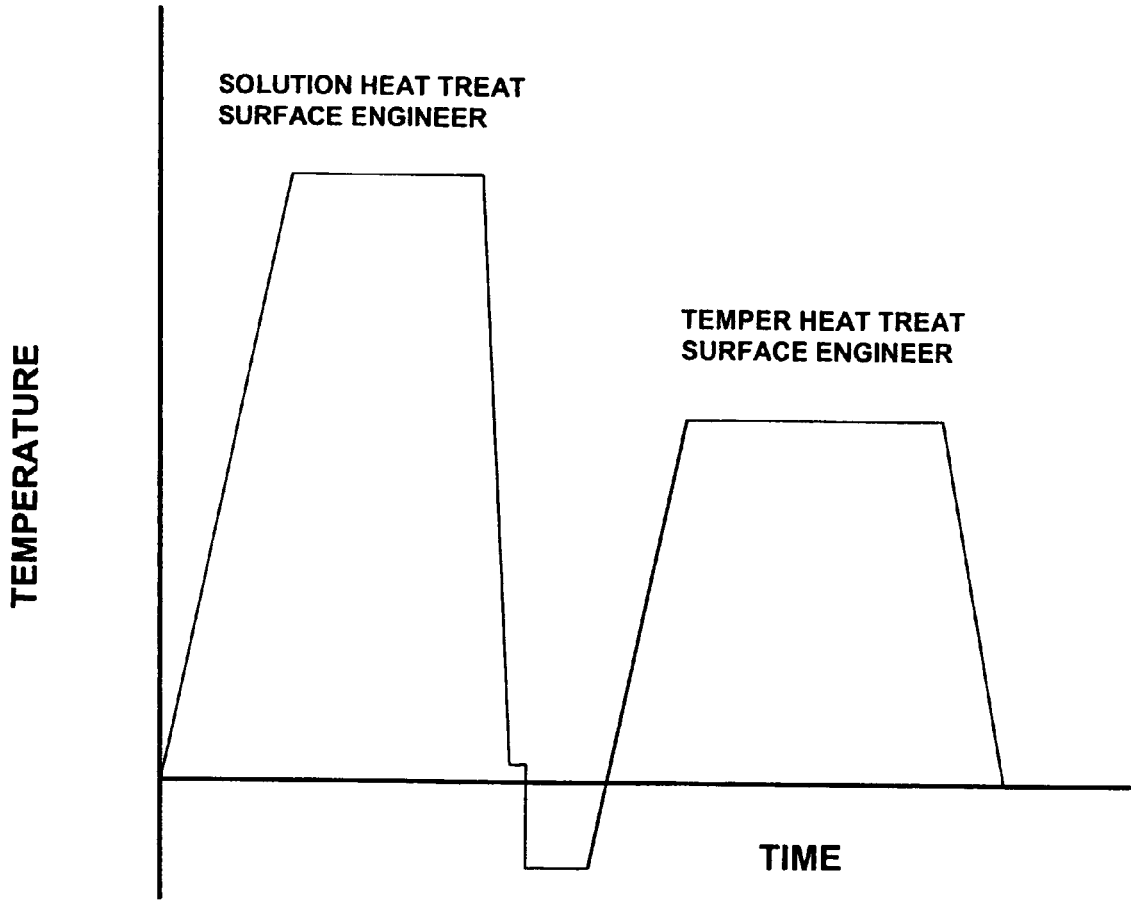
FIG. 2 is a thermochemical temperature-time schematic showing possible combinations of bulk alloy heat treatments and surface engineering treatments.

FIG. 2 shows a schematic representation of a thermochemical temperature-time process, indicating regimes where, at relatively high temperatures, alloy solution heat treatment can be combined with a surface engineering process, such as carburizing. Similarly, at relatively lower or intermediate temperature regimes typically used for tempering HSHT alloys, surface engineering processes, such as nitriding, may be run concurrently. The high temperature combinations, and the lower or intermediate temperature combinations may be used independently to correspondingly reduce manufacturing cycle time. Preferably, the high temperature combinations, and the lower or intermediate temperature combinations may be used in sequence to correspondingly minimize manufacturing cycle time.

The benefits of using both carburizing and nitriding surface engineering processes on a product include the capability of providing sufficient case depth for bending stress requirements from carburizing and also enhanced surface hardness, corrosion resistance and, in particular, essentially the elimination of dimensionalizing processes subsequent to the nitriding process.

The HSHT alloys are iron-based alloys that are generally nitrogen-free and have an associated composition and hardening heat treatment, including a tempering temperature. The tempering temperature is dependent on the HSHT alloy composition and is the temperature at which the HSHT alloy is heat processed to alter characteristics of the HSHT alloy, such as hardness, strength, and toughness.

The composition of the HSHT alloys is essentially a Ni—Co secondary hardening martensitic steel, which provides high strength and high toughness. That is, the ultimate tensile strength of the HSHT alloy is greater than about 170 ksi and the yield stress is greater than about 140 ksi and in some examples the ultimate tensile strength is approximately 285 ksi and the yield stress is about 250 ksi. High strength and high toughness provide desirable performance in such applications as power transmission components. Conventional vacuum melting and remelting practices are used and may include the use of gettering elements including, for example, rare earth metals, Mg, Ca, Si, Mn and combinations thereof, to remove impurity elements from the HSHT alloy and achieve high strength and high toughness. Impurity elements such as S, P, O, and N present in trace amounts may detract from the strength and toughness.

Preferably, the alloy content of the HSHT alloy and the tempering temperature satisfy the thermodynamic condition that the alloy carbide, $M_2C$ where M is a metallic carbide-forming element, is more stable than $Fe_3C$ (a relatively coarse precursor carbide), such that $Fe_3C$ will dissolve and $M_2C$ alloy carbides precipitate. The $M_2C$ alloy carbide-forming elements contribute to the high strength and high toughness of the HSHT alloy by forming a fine dispersion of $M_2C$ precipitates that produce secondary hardening during a conventional precipitation-heat process prior to any surface processing. The preferred alloy carbide-forming elements include Mo and Cr, which combine with carbon in the metal alloy to form $M_2C$. Preferably, the HSHT alloy includes between 1.5 wt % and 15 wt % Ni, between 5 wt % and 30 wt % Co, and up to 5 wt % of a carbide-forming element, such as Mo, Cr, W, V or combinations thereof, which can react with up to approximately 0.5 wt % C to form metal carbide precipitates of the form $M_2C$. It is to be understood that the metal alloy may include any one or more of the preferred alloy carbide-forming elements.

The carbide-forming elements provide strength and toughness advantages because they form a fine dispersion of $M_2C$. Certain other possible alloying elements such as Al, V, W, Si, Cr, may also form other compounds such as nitride compounds. These alloying elements and the carbide-forming elements influence the strength, toughness, and surface hardenability of the HSHT alloy.

Alloys that fall within the compositional range include the following forms of the alloy class: (a) ribbon, flakes, particulates or similar form produced by rapid solidification from the liquid or mixed liquid-solid phase; (b) those formed through consolidation or densification from powders or particles, including but not limited to sintered and hot-isostatically-pressed (HIP'ed) forms; (c) those produced by or in all types of castings; (d) those produced by forging or other wrought methods, irrespective of process temperature (cold, warm, or hot); (e) those produced by stamping or coining; and (f) those produced by the consolidation of or including nanometer, or substantially similar, sized particles.

The present invention teaches thermochemical process steps that, when applied to a class of high strength, high toughness alloys and products thereof, minimize the manufacturing cycle times, costs and delivery; while retaining the desired increase in performance capability. Products of the alloy class may be in multiple forms.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

Although the present invention has been described with reference to preferred embodiments, workers skilled in the art will recognize that changes may be made in form and detail without departing from the spirit and scope of the invention.

What is claimed is:

1. A method of treatment of metal alloys, the method comprising:

concurrently performing a high temperature solution heat treatment and a first surface engineering process on a metal alloy component;

quenching the component;

refrigerating the component; and tempering the component and performing a second surface engineering process concurrently with tempering.

2. The method of claim 1, wherein the second surface engineering process comprises nitriding a surface of the component.

3. The method of claim 1, wherein the tempering is performed in a range of about 800° F. and about 950° F.

4. The method of claim 1, wherein the first surface engineering process comprises carburizing a surface of the component.

5. The method of claim 1, wherein the metal alloy is a nickel cobalt steel.

6. The method of claim 5, wherein the metal alloy comprises at least 1.5 wt % nickel, at least 5 wt % cobalt, up to 1.0 wt % carbon, and up to 15 wt % of molybdenum, chromium, tungsten, or vanadium and combinations thereof.

7. The method of claim 1, wherein the high temperature solution heat treatment and the first surface engineering process are performed in a range of about 1500° F. and about 2100° F.

8. The method of claim 1, wherein the metal alloy comprises a nickel cobalt steel including at least 1.5 wt % nickel and at least 5 wt % cobalt.

9. The method of claim 8, wherein the metal alloy comprises up to 1.0 wt % carbon.

10. The method of claim 9, wherein the metal alloy comprises up to 15 wt % of molybdenum, chromium, tungsten, or vanadium and combinations thereof.

* * * * *